US009883733B2

(12) United States Patent
Roehrig

(10) Patent No.: US 9,883,733 B2
(45) Date of Patent: Feb. 6, 2018

(54) DEVICE FOR RETAINING AND STORING A PACIFIER

(71) Applicant: MAM BABYARTIKEL GESELLSCHAFT M.B.H., Vienna (AT)

(72) Inventor: Peter Roehrig, Vienna (AT)

(73) Assignee: MAM BABYARTIKEL GESELLSCHAFT M.B.H., Vienna (AT)

( * ) Notice: Subject to any disclaimer, the term of this patent is extended or adjusted under 35 U.S.C. 154(b) by 0 days.

(21) Appl. No.: 14/917,497

(22) PCT Filed: Sep. 16, 2014

(86) PCT No.: PCT/AT2014/050207
§ 371 (c)(1),
(2) Date: Mar. 8, 2016

(87) PCT Pub. No.: WO2015/035440
PCT Pub. Date: Mar. 19, 2015

(65) Prior Publication Data

US 2016/0213136 A1 Jul. 28, 2016

(30) Foreign Application Priority Data

Sep. 16, 2013 (AT) ..... A 50586/2013

(51) Int. Cl.
*A45F 5/02* (2006.01)
*A61J 17/00* (2006.01)
*A45F 5/00* (2006.01)

(52) U.S. Cl.
CPC ..... *A45F 5/02* (2013.01); *A45F 5/00* (2013.01); *A61J 17/008* (2015.05);
(Continued)

(58) Field of Classification Search
CPC ..... A45F 2005/006; A45F 5/00; A45F 5/02; A61J 17/001; A61J 17/008
See application file for complete search history.

(56) References Cited

U.S. PATENT DOCUMENTS 4,765,037 A * 8/1988 Perry ..... A61J 17/00 24/3.13
4,903,698 A * 2/1990 Huber ..... A61J 9/06 24/17 AP (Continued)

FOREIGN PATENT DOCUMENTS

AT 006 722 U1 3/2004
DE 94 07 164 U1 4/1994

(Continued)

OTHER PUBLICATIONS

International Search Report of International Application No. PCT/AT2014/050207, dated Dec. 18, 2014.

(Continued)

*Primary Examiner* — Robert J Sandy
*Assistant Examiner* — David Upchurch
(74) *Attorney, Agent, or Firm* — Greenblum & Bernstein, P.L.C.

(57) ABSTRACT

A pacifier strap for connecting a pacifier to a fastening clip. The pacifier strap forms a loop at at least one end and includes a loop adjuster configured to adjust the length of the loop so that the length of the pacifier strap itself can be adjusted between a first length, in which the loop has a maximum length, and a second length, in which the loop has a minimum length. In addition, the pacifier strap has a container configured to receive at least one nipple of the pacifier, which container can be connected, at least temporarily, to the loop adjuster.

17 Claims, 11 Drawing Sheets

(52) U.S. Cl.
CPC ... *A45F 2005/006* (2013.01); *A45F 2005/023* (2013.01); *A61J 17/001* (2015.05)

(56) References Cited

U.S. PATENT DOCUMENTS

| | | | | | |
|---|---|---|---|---|---|
| 4,972,980 | A * | 11/1990 | Parsons | A61J 17/00 | 224/194 |
| 4,990,157 | A * | 2/1991 | Roberts | A45F 5/02 | 128/846 |
| 5,150,504 | A * | 9/1992 | Cohen | A45F 5/02 | 24/3.13 |
| 5,156,617 | A | 10/1992 | Reid | | |
| 5,459,903 | A * | 10/1995 | Treacy | A61J 9/06 | 24/115 G |
| 5,578,058 | A * | 11/1996 | Chen | A61J 17/00 | 606/234 |
| 5,948,003 | A | 9/1999 | Shefflin | | |
| 5,954,749 | A * | 9/1999 | Fields | A61J 17/00 | 606/234 |
| D415,837 | S * | 10/1999 | Williams | D24/193 | |
| 5,964,784 | A * | 10/1999 | Wang | A61J 17/00 | 606/234 |
| 6,312,449 | B1 * | 11/2001 | Chang | A45F 3/14 | 606/234 |
| 6,434,797 | B1 * | 8/2002 | Sagman | A61J 17/00 | 24/3.1 |
| 6,606,768 | B2 | 8/2003 | Henry et al. | | |
| 6,638,298 | B1 * | 10/2003 | Shefflin | A45C 11/24 | 606/234 |
| 7,086,121 | B2 * | 8/2006 | Lippincott | A61J 17/00 | 2/1 |
| 7,204,845 | B2 * | 4/2007 | Rohrig | A45C 11/24 | 606/234 |
| 8,011,069 | B1 | 9/2011 | Klein | | |
| 8,029,538 | B2 * | 10/2011 | Burroughs | A61J 17/02 | 215/11.1 |
| 2004/0178085 | A1 | 9/2004 | Roehrig | | |

FOREIGN PATENT DOCUMENTS

| | | | |
|---|---|---|---|
| DE | 196 21 863 | A1 | 12/1997 |
| DE | 203 18 167 | U1 | 3/2004 |
| GB | 2 388 041 | A | 7/2002 |
| WO | WO-2013/120176 | A1 | 8/2013 |

OTHER PUBLICATIONS

Chinese Office Action issued in Counterpart Patent Appl. No. 201480050970.0, dated Sep. 29, 2017, along with an English translation thereof.

* cited by examiner

DEVICE FOR RETAINING AND STORING A PACIFIER

BACKGROUND

1. Field of the Invention

The invention relates to a pacifier strap for connecting a pacifier to a fastening clip, said pacifier strap forming a loop at at least one end and having adjustment means for adjusting the length of the loop, so that the longitudinal extension of the pacifier strap can be adjusted between a maximum length of the loop and a minimum length of the loop, and having a container for receiving at least one nipple of the pacifier.

2. Description of the Background

As is well-known, the use of a pacifier strap for connecting a pacifier, for example, to the clothes of a child prevents the loss of the pacifier when the child does not want to keep the pacifier in its mouth without interruption or the pacifier unintentionally falls out of the child's mouth, for example. In this manner, the pacifier may be quickly found when the child is missing it and does not fall onto the ground—when the child is sitting e. g. in a baby carriage.

In this context, it is advantageous to be able to adapt the length of the pacifier strap to the circumstances, since a pacifier strap that is too short impedes its fastening or restricts the mobility when the pacifier is in use, and on the other hand a pacifier strap that is too long may be obstructive when the pacifier is not in use, or, when the child is crawling, the pacifier may still be dragged over the floor despite its being fastened to the pacifier strap, which is a situation that should be avoided.

A pacifier strap whose length is adjustable is already known from U.S. Pat. No. 4,765,037. The length of the loop of the pacifier strap shown therein may be adjusted at various positions by using snaps. As an alternative, the length of the loop may also be modified by shifting the pacifier strap in two rings arranged offset with respect to each other.

From U.S. Pat. No. 6,606,768, too, a length-adjustable strap to be used as a pacifier strap is shown, wherein the size of the loop that reduces the length may be adjusted by hook and loop connections at various positions along the strap.

Apart from the advantageous prevention of a loss of the pacifier and the easy traceability, a pacifier connected to such a pacifier strap is exposed to essential environmental influences—when it is not being used—which clearly exceed the usual degree, i. e. when the pacifier is accommodated in a pocket or the like. For example, the pacifier can get soiled regularly when a child is playing on the ground, and moreover, the child may be hardly prevented from subsequently still using the pacifier and being thus subjected to increased health risks.

It is just in combination with the use of a pacifier strap that it is particularly desirable to protect the pacifier or the nipple of the pacifier from soiling and mechanical damage. Such protection may be provided, for example, by a pacifier container. However, the problems cited above in connection with the pacifier, i. e. a frequent loss and bad traceability, equally apply to both a pacifier container and the pacifier itself.

AT 006 722 U1 shows a pacifier container which is attached to a pacifier strap by the pacifier strap being passed through two flaps at the sides of the container. Due to the natural flexibility of the pacifier strap, the fastening must be designed such that an unintentional release of the container from the pacifier strap, for example when the pacifier strap is shifted and deformed, is reliably avoided. As a disadvantage, a quick release of the container from the pacifier strap becomes impossible, and the pacifier may at most be accommodated in the container left at the pacifier strap.

U.S. Pat. No. 6,638,298 B1 discloses a combination of a pacifier clip and a nipple part cover fixed to a pacifier strap, both elements being firmly connected to each other.

U.S. Pat. No. 5,948,003 A shows a pacifier clamp which is connected to a pacifier via a pacifier strap and which is large enough and shaped so as to be able to receive the nipple of the pacifier. However, the clamp has no adjustment means, and no other length adjustment of the strap is provided.

In U.S. Pat. No. 5,156,617 A, a pacifier case with a base plate and a cover part hinged to it is disclosed. A pacifier is connected to the case via a strap, the strap forming a loop at its end which passes through an opening of the nipple. Furthermore, the pacifier may be attached to the base plate with a snap in the case.

Finally, WO 2013/120176 A1 describes a pocket to which are fixed on the one hand a pacifier strap with a pacifier and on the other hand a clamp.

SUMMARY

Compared to the well-known pacifier straps and pacifier containers, it is therefore the object of the invention to provide a pacifier strap which is on the one hand length-adjustable and additionally provides a container for protecting a pacifier connected to the pacifier strap which container can be quickly found and used and may be reliably connected to the pacifier or the pacifier strap both in a storage position, i.e. when the pacifier is accommodated in the container, and in a ready position, i. e. when the pacifier is in use.

The pacifier strap according to the invention of the type stated in the beginning achieves this object by the container for receiving the nipple being at least temporarily connectable to the adjustment means. The adjustment means thus fulfill a double function, i. e. they may be used both for adjusting the length of the pacifier strap and for fastening the pacifier container. The connection between the adjustment means and the container may be such that a quick establishment and release of the connection is permitted, however without affecting the reliability of said connection. This solution is, compared to a direct connection of the container to the pacifier strap, advantageous in that the adjustment means may be correspondingly adapted to the connection requirements, by providing, for example, dedicated connection elements, and do not have to comprise the flexibility of the pacifier strap.

In this context, it has proven to be particularly advantageous for the container for receiving the nipple to be fitted onto the adjustment means and to be in particular held on the adjustment means by means of a snap-in connection. This type of connection is mainly applicable with mechanically stable adjustment means, wherein preferably the container and the adjustment means may be essentially made of the same material.

To keep the construction of the adjustment means preferably simple and inexpensive, it is advantageous for the container for receiving the nipple to comprise connection means to be fixed to the adjustment means, in particular hook-like connection means for engagement with an edge of the adjustment means. Thereby, for example common adjustment means may be used rather without modifications, so that the operation of the adjustment means when the length of the pacifier strap is being adapted is moreover not hampered by any connection means for the connection to the container.

For the manufacture and efficiency of a pacifier strap according to the invention, it is particularly advantageous to form the adjustment means and the container for receiving the nipple integrally. Compared to the well-known container directly attached to the pacifier strap, with this embodiment, an inexpensive pacifier strap is created in which some parts may be eliminated. Moreover, the length of the pacifier strap may be adjusted such that an unintentional removal of the pacifier from the container is largely prevented.

If the container for receiving the nipple comprises two container halves that are preferably connected to each other in swivelling manner, the nipple may be completely stored in the container by opening and closing the container halves. In particular, the container formed in this way may be closed at all sides and tightly terminate with the nipple and thus surround it completely. Moreover, a reliable accommodation of the nipple in the container and a secure connection between the nipple and the container are thereby achieved.

A particularly compact embodiment is achieved if one container half is advantageously integrally formed or firmly connected to the adjustment means, and the other container half to the fastening clip.

Furthermore, the loop formed by the pacifier strap may be closed via the adjustment means by the pacifier strap being connected to the adjustment means on the one hand with a fixed length and on the other hand with a variable length, in particular so as to be shifting preferably at one end of the pacifier strap. Since the pacifier strap in this case only has one degree of freedom with respect to the adjustment means, and only one of the two connections between the adjustment means and the pacifier strap permits a shifting of the adjustment means along the pacifier strap, an unintentional release of the adjustment means and of any pacifier container possibly connected thereto from the pacifier strap may be prevented. In particular, with such an arrangement, for example some equipment arranged at an end of the pacifier strap opposed to the loop, e. g. a fastening element for the pacifier, may form restriction means.

Adjustment means that are particularly easily producible and simultaneously particularly suited for being connected to a container are given if the adjustment means are embodied as a buckle with at least one opening for passing through the pacifier strap, in particular with an insertion opening and an outlet opening. Such a buckle may moreover be actuated easily and does not show any signs of wear even if it is frequently used (as is the case, for example, with a hook and loop fastener or the like).

Furthermore, it proved to be advantageous for the pacifier strap to comprise restriction means by which a maximum length of the loop is defined. The restriction means thus prevent an extension of the loop formed by the pacifier strap beyond a maximum length, and in particular an opening or release of the loop. An opening of the loop is thus only possible after the removal of the restriction means or cutting through of the pacifier strap. Since the loop accordingly may at least not be opened unintentionally, the connection between the pacifier strap and any equipment held in the loop, in particular the fastening clip, is ensured permanently.

With the embodiment of the adjustment means as a buckle with at least one opening for passing through the pacifier strap, the length of the loop may be particularly easily restricted if the restriction means comprise a stop element which protrudes from the opening, in particular the outlet opening, of the buckle. Such a stop element blocks a shifting of the buckle beyond the stop element, and the stop position in which the buckle touches the stop element thus defines the maximum length of the loop.

A particularly advantageous embodiment of said stop element which is easy to manufacture consists in the stop element being formed by folding the pacifier strap, the folding being fixed by a seam or weld. Here, not only the minimum additional material requirements for manufacturing the stop element, but also its optical unobtrusiveness are advantageous. Simultaneously, the risk of the child getting hurt at the stop element—for example by chewing or scratching—or of the child swallowing a released stop element, is minimized. As an alternative, in particular also a part of a fixing element (retainer ring, loop, etc.) for the pacifier may be embodied as a stop element.

For a particularly easy handling it is advantageous for the container for receiving the nipple to be guided via the adjustment means at the pacifier strap such that, with a maximum length of the loop, i.e. with a minimum longitudinal extension of the pacifier strap, the nipple of the pacifier is guided into the container embodied as pacifier cap. Thus, the pacifier strap has, in such an arrangement in a storage position, i.e. when the pacifier nipple is disposed in the container provided to this end, the smallest longitudinal extension, whereby it does not cause any, or hardly any, encumbrance for the user or the child, respectively.

In this context, the pacifier cap may moreover be held via a frictional connection between the adjustment means and the pacifier strap in a position receiving the nipple, whereby it is ensured that the pacifier cap remains on the nipple even without any additional connection means between the pacifier cap and the pacifier. Such an arrangement may be accordingly employed universally and, for example, completely independent of the type and shape of a pacifier plate or the nipple.

BRIEF DESCRIPTION OF THE DRAWINGS

The invention will be further illustrated below with respect to particularly preferred exemplified embodiments which, however, are not intended to restrict the invention, and with reference to the drawings. The drawings show in detail.

DETAILED DESCRIPTION

Figure 1:
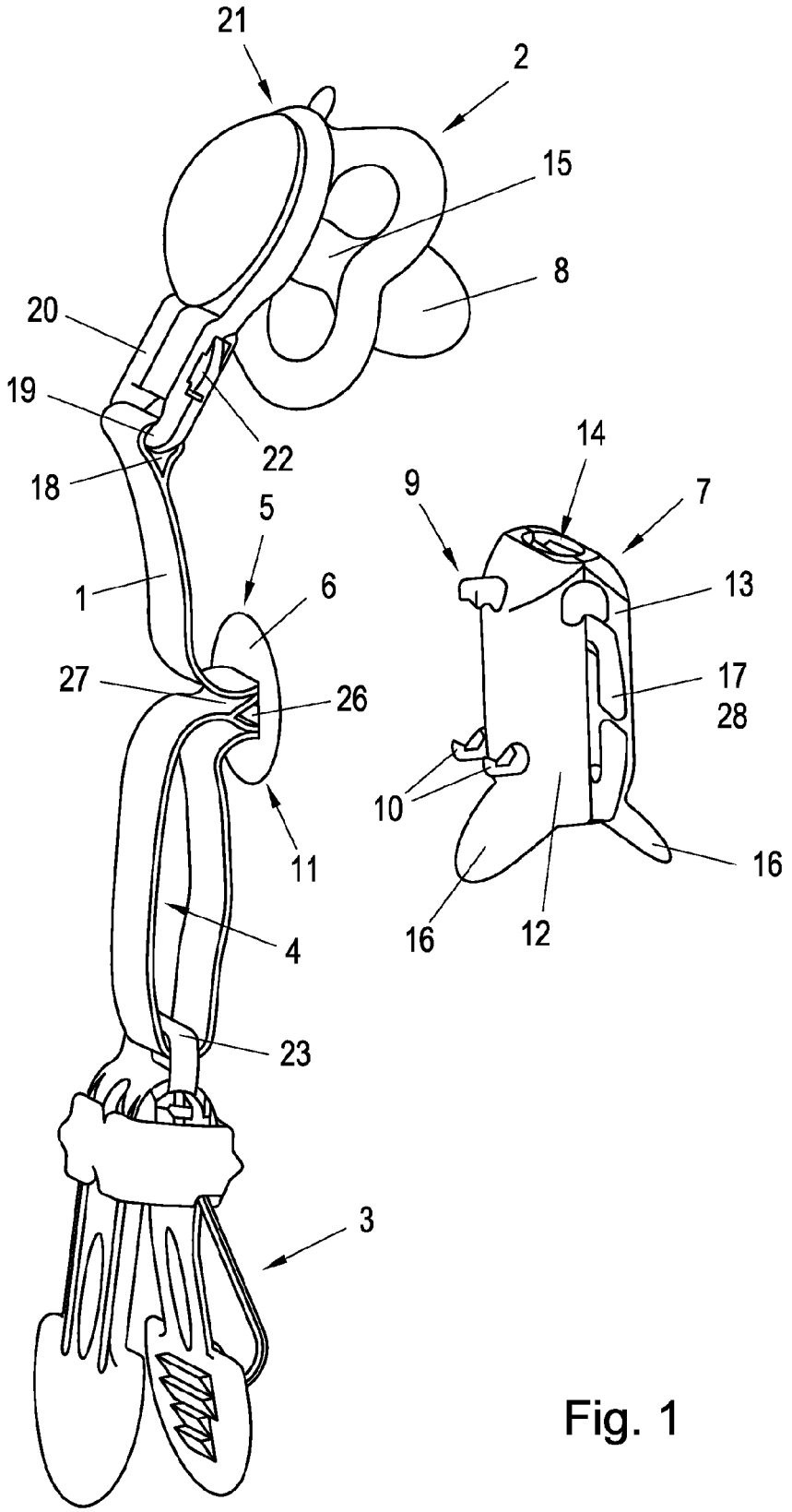
FIG. 1 a diagrammatic view of a pacifier strap with a pacifier container, a pacifier and a fastening clip.

FIG. 1 shows a pacifier strap 1 with a pacifier 2 and a fastening clip 3 which are connected with one end each of the pacifier strap 1. At the end facing the fastening clip 3, the pacifier strap 1 forms a loop 4, the loop 4 being closed via adjustment means 5 in the form of a buckle 6. Adjacent to the adjustment means 5, FIG. 1 also represents a container 7 which is adapted for receiving the nipple 8 of the pacifier 2; naturally, a container 7 receiving the complete pacifier 2 may also be provided. On a side facing the adjustment means 5, the container 7 includes connections means 9 in the form of hook-like pins 10 formed at the container 7 for engagement with the edge 11 of the buckle 6.

The container 7 includes two container halves 12, 13, an opening 14 for a shaft 15 of the nipple 8 being provided on one side. On a side opposed to the opening 14, the container halves 12, 13, each include one grip part 16, the two grip parts 16 extending obliquely in opposed directions, so that an opening angle is included between the grip parts 16. On a narrower longitudinal side of the container 7, a flap 17 is arranged which permits an alternative type of fastening the container 7 to the pacifier strap 1. Thereby, for example a further similar container 7 may be fixed to the pacifier strap 1 by means of the flap 17 for storing a second or spare pacifier (not shown).

The pacifier 2 is connected to one end of the pacifier strap 1 via a fastening loop 18 which has a fixed length. In particular, in the fastening loop 18, a cross strut 19 of a connection part 20 of the pacifier plate 21 is arranged. The connection part 20 is connected to the pacifier plate 21 in a swiveling manner, the swiveling axis being essentially parallel to the extension axis of the nipple 8. The connection part 20 is closed by a closing hook 22, so that an unintentional opening of the connection part 20 and subsequent release of the pacifier 2 from the pacifier strap 1 is prevented. The fastening clip 3 is connected to the loop 4 formed by means of the adjustment means 5 at the other end of the pacifier strap 1 by a fastening bow 23 originating from the fastening clip 3 being arranged in the loop 4. The functioning of the fastening clip 3 is known per se and will therefore not be illustrated more in detail herein.

The adjustment means 5 are formed as a buckle 6 with at least one opening 24, 25 (cf. FIG. 2) for passing through the pacifier strap 1, in particular with an insertion opening 24 and an outlet opening 25. Between the openings 24, 25, the buckle 6 has a web 26, where the pacifier strap 1 is on the one hand connected to the web 26 by means of a further fastening loop 27 of a fixed length in an essentially stationary and thus length-invariable manner, and on the other hand surrounds the web 26 through the insertion opening 24 and the outlet opening 25 outside the loop 27, so that this part of the pacifier strap 1 disposed further outside compared to the web 26 is connected to the buckle 6 in a shifting and thus length-variable manner. By shifting the pacifier strap 1 with respect to the buckle 6, the length of the loop 4 closed by the buckle 6 may be changed and thus the longitudinal extension of the pacifier strap 1, that is, the effective length of the pacifier strap 1, may be varied. In this way, the buckle 6 can be considered a type of a loop-length adjuster 5. Other adjusters are described below.

The three pins 10 forming the hook-like connection means 9, or grooved connector structure, are arranged such that the distance between opposed pins 10 essentially corresponds to the diameter of the buckle 6. Thus, the buckle 6 may be snapped into corresponding snap-in grooves 28 formed each at one side of the pins between the pins 10. The circular shape of the buckle's edge 11 represented in this exemplary embodiment is particularly advantageous, as an edge connector structure, since the container 7 may be snapped onto the buckle 6 rotated as desired with respect to the pacifier strap 1. To counteract a release of the buckle 6 from the container 7 by lateral shifting, at least three pins 10 may be provided which, with respect to a buckle 6 that snaps in, are located not exactly diametrically opposed to each other but somewhat laterally offset. Instead of the shown pin-like connection means 9, however, for example two opposite oblong or strip-like elements may be provided which comprise corresponding lateral snap-in grooves.

Figure 2:
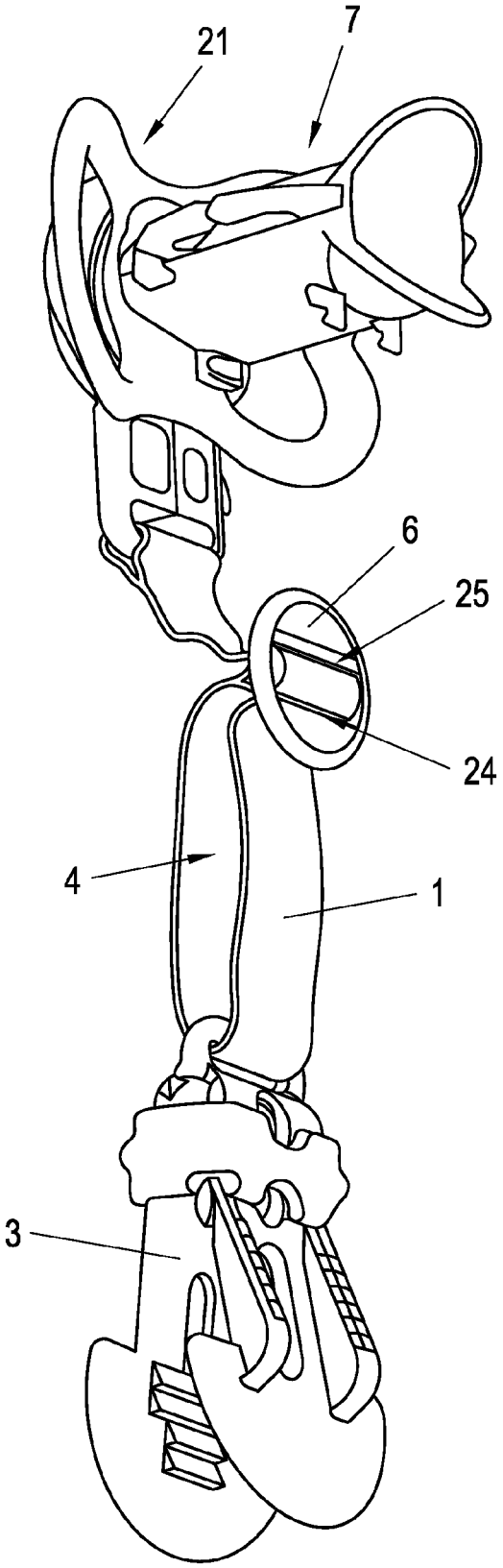
FIG. 2 a diagrammatic view of a pacifier strap according to FIG. 1 in a storage position.

FIG. 2 shows the container 7 in a storage position, where the nipple 8 of the pacifier 2 is received between the container halves 12, 13. The container 7 encloses the complete nipple 8 including its shaft 15 and essentially reaches to the pacifier plate 21. Any soiling of the nipple 8 is thus effectively prevented by the container 7. In addition, the container 7 may be attachable to the pacifier plate 21, so that the nipple 8 is even better protected from mechanical loads, such as squeezing, twisting or bending with respect to the pacifier plate 21.

Figure 3:
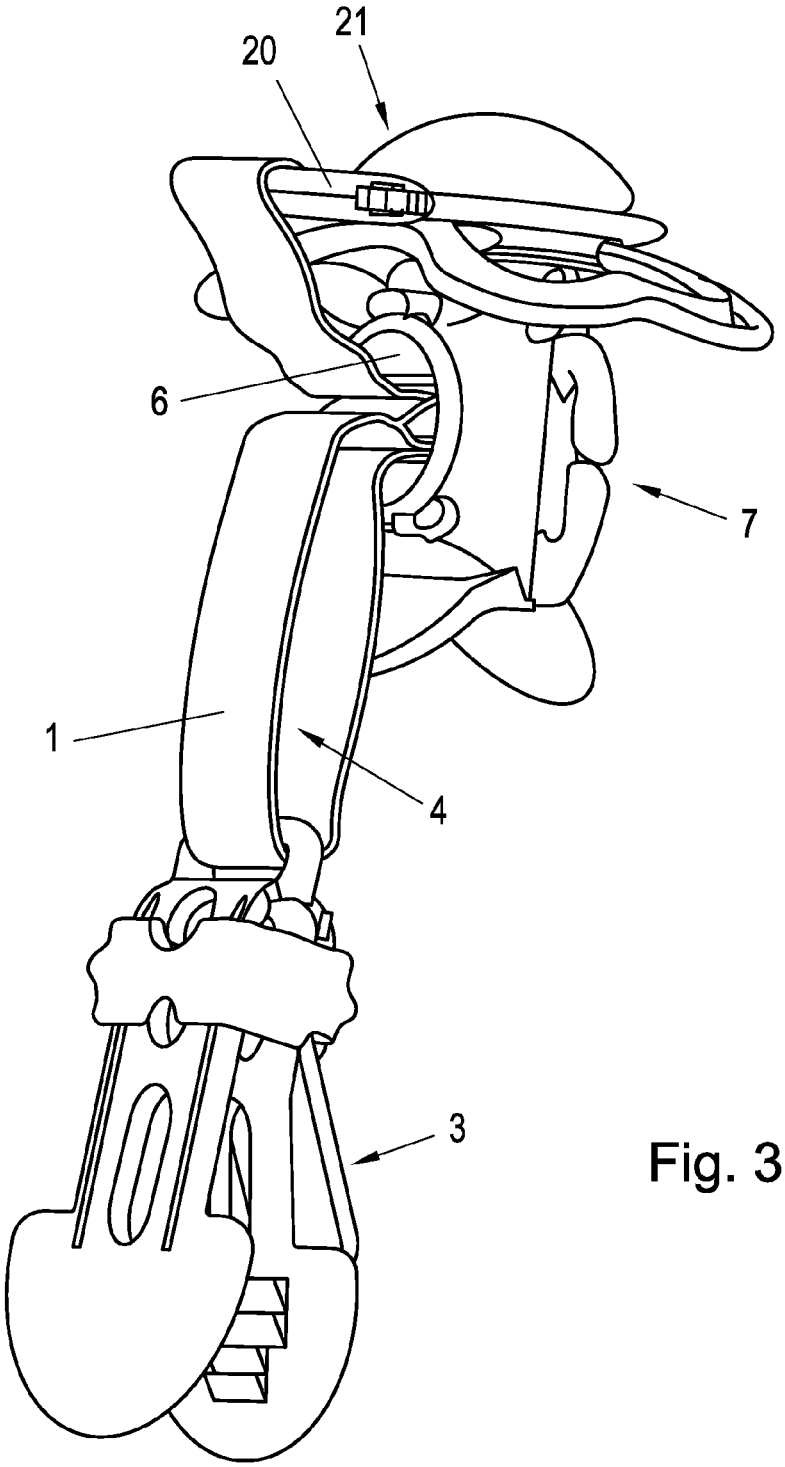
FIG. 3 a further diagrammatic view of a pacifier strap according to FIG. 1 in a modified storage position.

In the alternative storage position represented in FIG. 3, the nipple 8 is—just as in FIG. 2—received in the container 7, where the container 7 is in addition snapped onto the buckle 6 or the buckle 6 snapped into the container 7. The longitudinal extension of the pacifier strap 1 is here particularly small, as the buckle 6 is shifted towards the pacifier plate 21 to an extent permitted by the connection part 20 when the nipple 8 is received in the container 7 connected to the buckle 6. This results in a particularly compact position of the complete arrangement. In order to prevent the buckle 6 from being shifted to any position close to the pacifier plate 21 or from being shifted off the pacifier strap 1, corresponding restriction means 29 are provided, as will be described in detail in connection with FIGS. 4A-6B, among others.

Figure 4A:
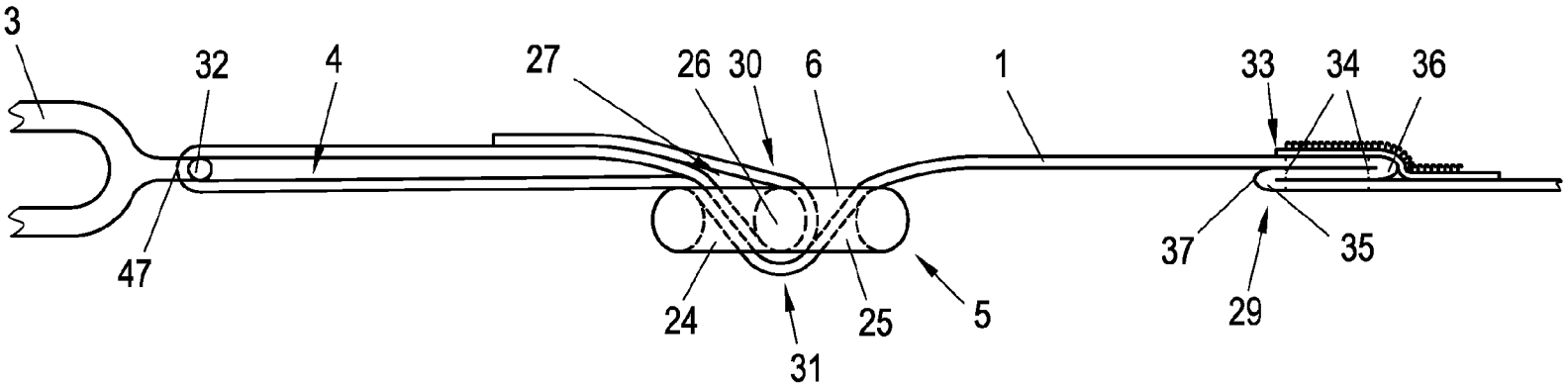
FIGS. 4A and 4B a side view and a plan view of a pacifier strap with restriction means in the form of a sewed folding.
Figure 4B:
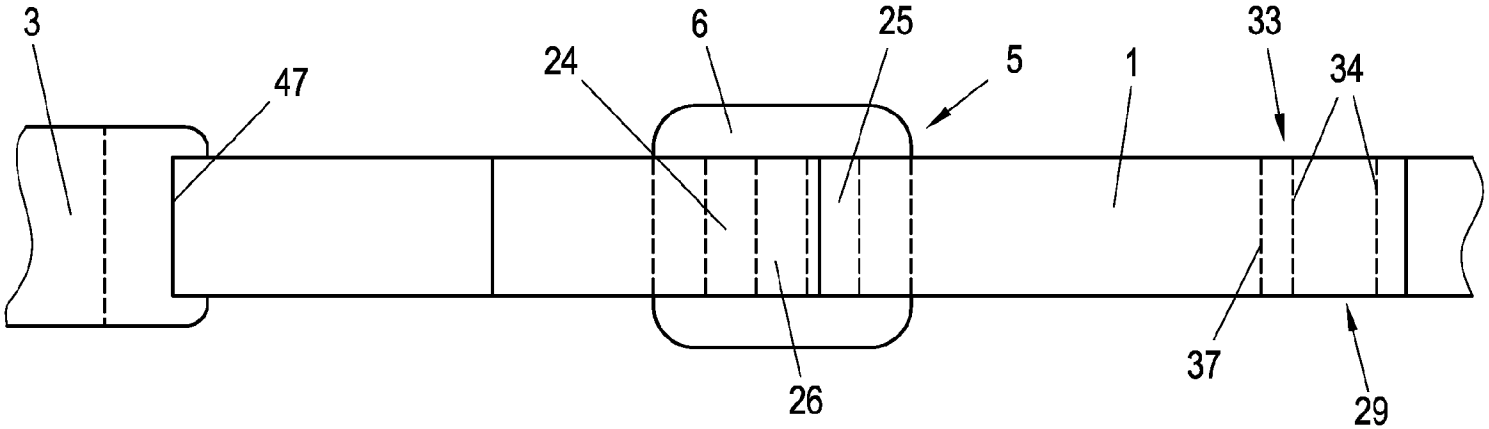

FIGS. 4A and 4B show a pacifier strap 1 of a textile material with adjustment means 5 in the form of a buckle 6 and restriction means 29. The buckle 6 has an insertion opening 24 and an outlet opening 25 through which the pacifier strap 1 is guided. The two openings 24, 25 are arranged in a plane and separated by a web 26. The openings 24, 25 are essentially rectangular, the longer side of the rectangle approximately corresponding to the width of the pacifier strap 1, and the shorter side approximately corresponding to twice the thickness of the pacifier strap 1.

One can moreover see in FIGS. 4A and 4B that the pacifier strap 1 is connected to the buckle 6 in two sections 30, 31, thus forming a loop 4 between the two sections 30, 31. In the loop 4, a retainer ring 32 is suitably arranged which is connected, for example, to a pacifier 2 or a fastening clip 3. The contacts between sections 30, 31 and the buckle 6 are formed on the one hand by a relatively small fastening loop 27 formed at one end of the pacifier strap 1 extending around the web 26 of the buckle 6, resulting in a length-invariable connection. The length of the fastening loop 27 which is formed by a seam or a welded joint (not shown) of the pacifier strap 1 on itself is invariable. On the other hand, a section 31 of a central part of the pacifier strap 1 also extends through the buckle 6 such that the pacifier strap 1 is movably connected to the buckle 6. This second connection is therefore length-variable with respect to the length of the loop 4 which is formed by the pacifier strap 1 and is thus variable. By the shape of the adjustment means 5 or the buckle 6 shown herein, a frictional connection between one end of the pacifier strap 1 or a fastening loop 27 and the section 31 of the pacifier strap 1 also arranged in the buckle 6 is established, and thus a loop 4 of variable length is formed.

The restriction means 29 shown in FIGS. 4A and 4B has a stop element 33 which is formed by an S-shaped folding of the pacifier strap 1, the folding being fixed by two seams 34. For forming the stop element 33, the pacifier strap 1 is folded over at two points 35, 36 following at a distance of about 0.5 to 1.5 cm, so that the thickness of the pacifier strap 1 is, in the region of the stop element 33, larger than the shorter side of the outlet opening 25 of the buckle 6. If the loop 4 is now enlarged by shifting or pulling the pacifier strap 1 from the right to the left (in FIG. 4A) through the buckle 6, the stop element 33 meets the buckle 6 when a maximum length of the loop 4 is reached. A further opening of the loop 4 will then only be possible when the seams 34 of the folding are removed or the buckle 6 or the pacifier strap 1 is destroyed. Since the folding at the side facing the buckle 6 comprises a protruding edge 37, the stop at the buckle 6 is enlarged when a maximum length is reached by additionally pulling the pacifier strap 1, and the stop element 33 is thus reliably prevented from slipping through the outlet opening 25 of the buckle 6.

Figure 5A:
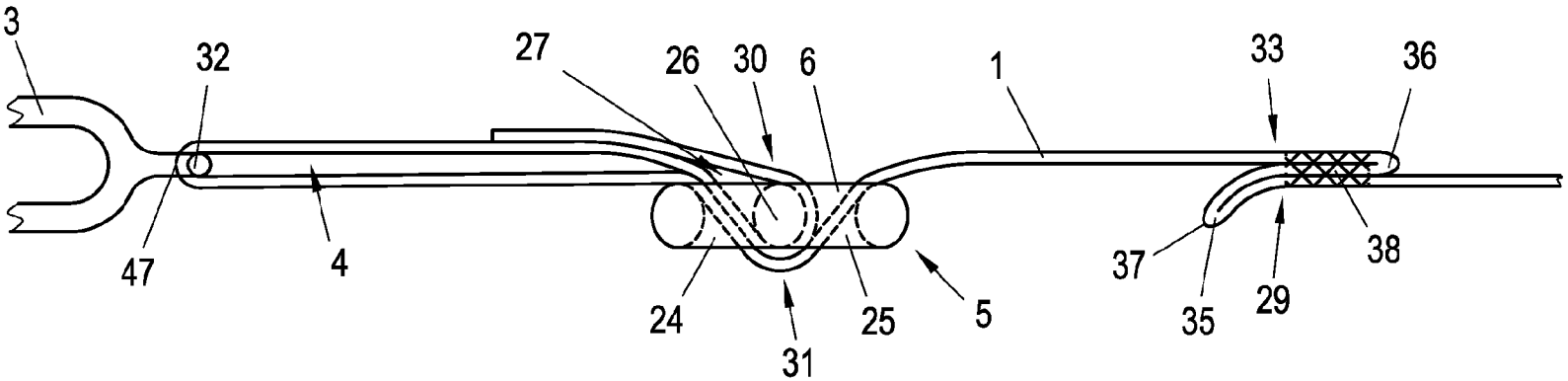
FIGS. 5A and 5B a side view and a plan view of a pacifier strap with restriction means in the form of a welded folding.
Figure 5B:
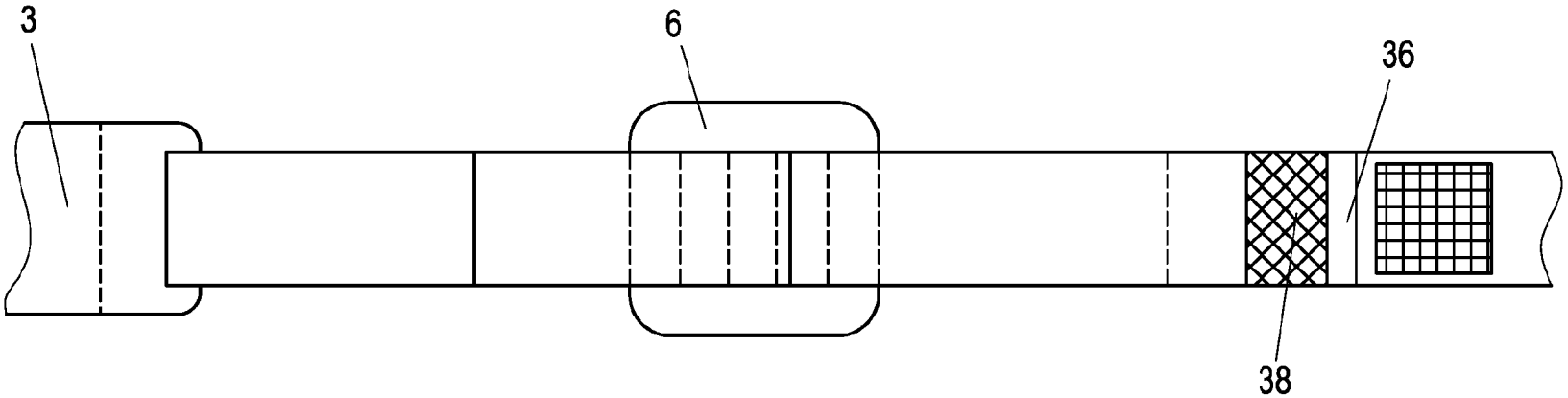

FIGS. 5A and 5B show a similar pacifier strap 1 as in FIG. 1, wherein, however, the folding forming the stop element 33 is fixed by a weld 38. It is particularly obvious that here, too, a protruding edge 37 is formed for improving the stop properties in that the weld 38 has not been provided in the complete region of the folding, but a section of the folding facing the buckle 6 has been left without welding.

Figure 6A:
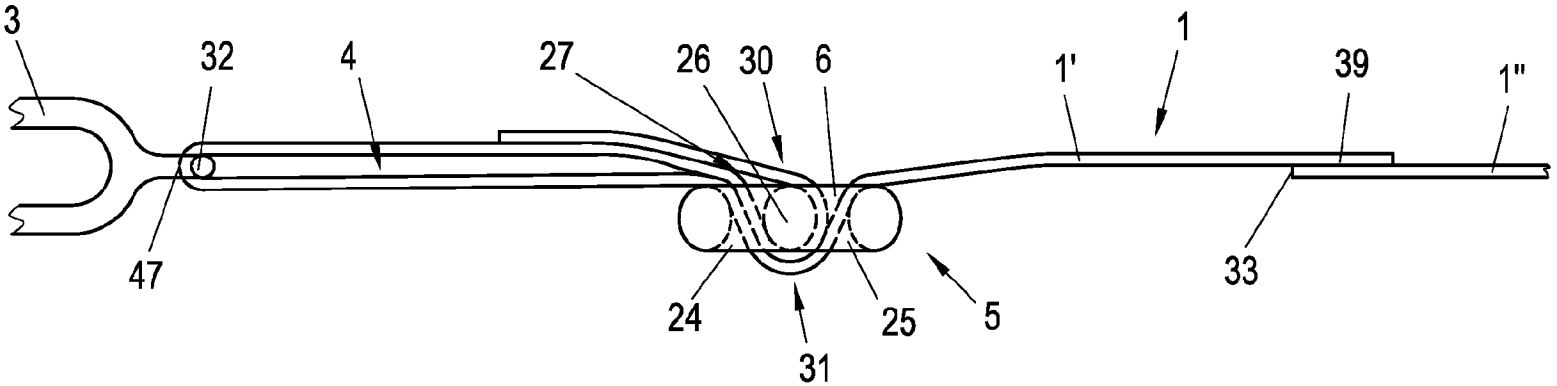
FIGS. 6A and 6B a side view and a plan view of a pacifier strap with restriction means in the form of a sewed overlap.
Figure 6B:
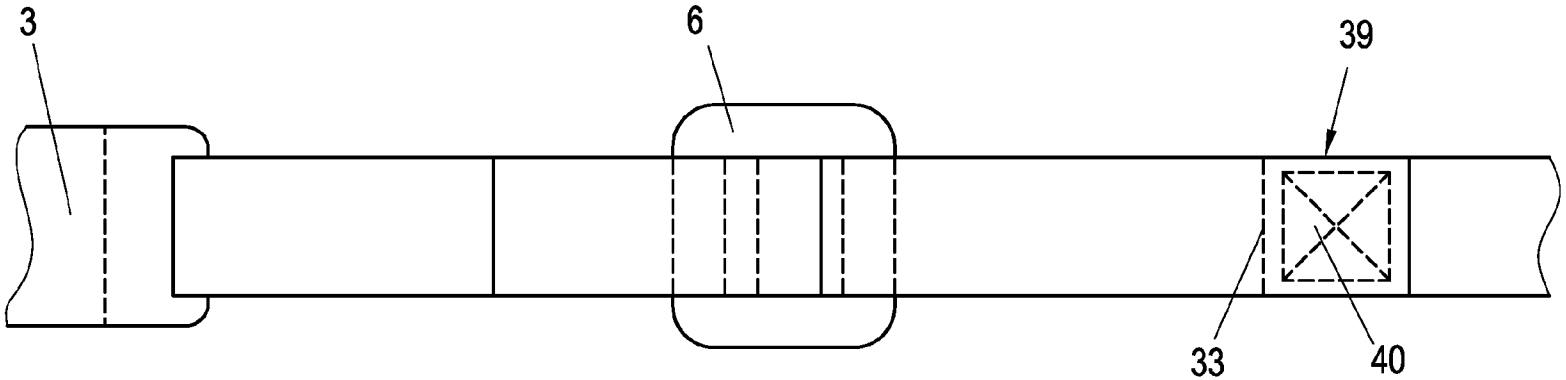

A further exemplified embodiment is shown in FIGS. 6A and 6B, wherein the stop element 33 is not formed by a folding, but by an overlap 39 of two pacifier straps 1', 1". The two pacifier straps 1', 1" are welded together in the region of the overlap 39, whereby an individual longer pacifier strap 1 with a stop element 33 in the form of the weld 40 is formed.

Figure 7:
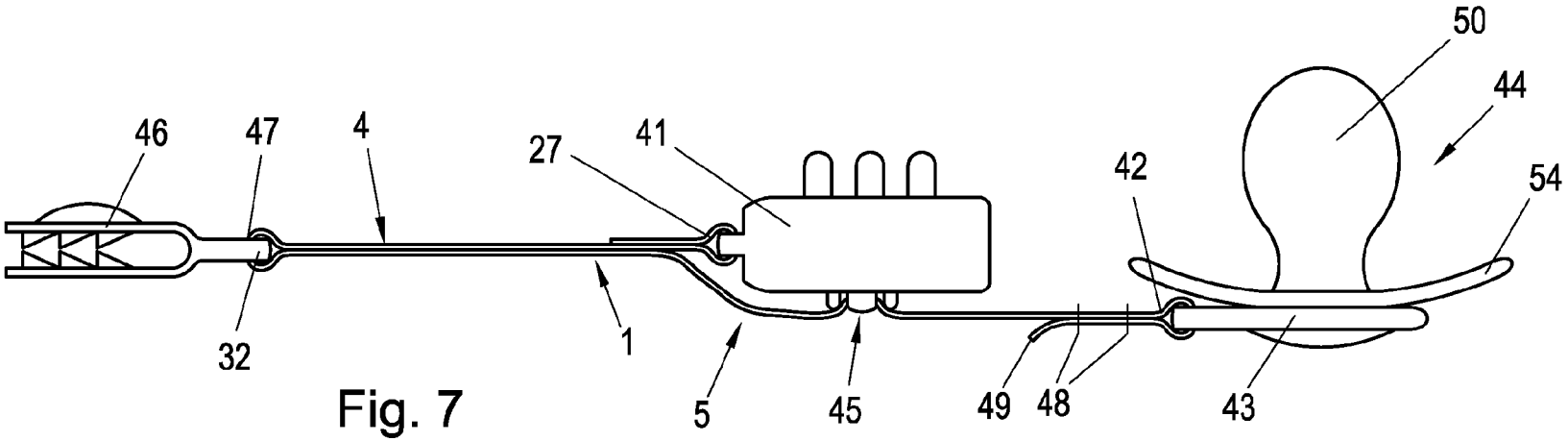
FIG. 7 a pacifier strap with a fastening clip, a pacifier and adjustment means which are integrally formed with a container for receiving a nipple of the pacifier.
Figure 8:
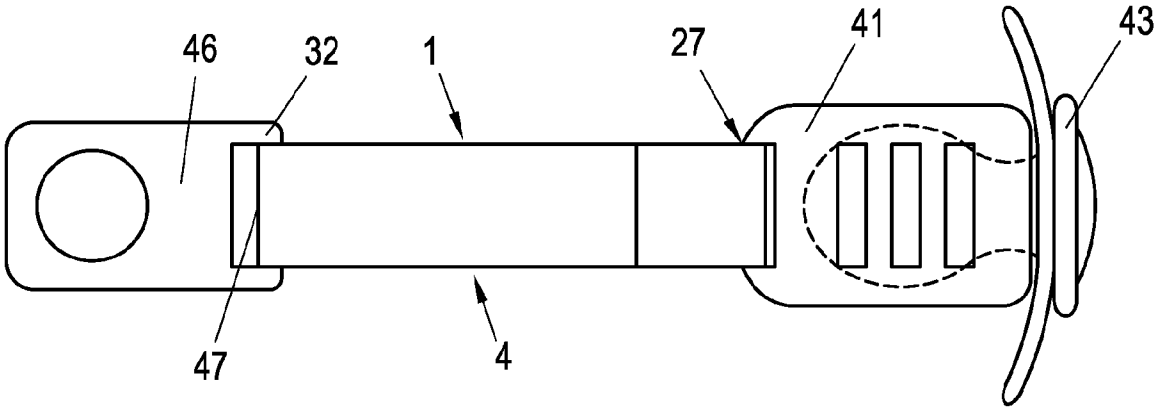
FIG. 8 a pacifier strap according to FIG. 7 in a storage position.

FIGS. 7 and 8 show an exemplary embodiment of a pacifier strap 1 according to the invention with adjustment means 5, or loop-length adjuster, integrally formed with a pacifier cap 41. The pacifier strap 1 comprises two relatively small fastening loops 42, 27 to which on the one hand a fastening element 43, in particular a retainer ring, for a pacifier 44, and on the other hand the pacifier cap 41 are connected. Of course, various connection elements, e.g. retainer loops, hook and loop connections, etc. may be employed instead of the retainer ring.

Moreover, the pacifier cap 41 has a further shiftable connection 45 to the pacifier strap 1. Between the connection by means of the fastening loop 27 and the connection 45 between the pacifier strap 1 and the pacifier cap 41, the pacifier strap 1 forms a loop 4 whose length may be adapted by shifting the pacifier cap 41 or the connection 45 along the pacifier strap 1. A fastening clip 46 is connected to the loop 4 by a retainer ring 32 arranged at the clamp 46 being arranged in the loop 4 and essentially at a crest 47 of the loop 4. The maximum length of the loop 4 is in this exemplary embodiment defined by the fastening loop 42 or its seam 48, wherein the end of the pacifier strap 1 forms a protruding edge 49 comparable to the edge 37 of FIGS. 1A and 2A.

In a storage position of the pacifier cap 41 fitted onto a nipple 50 of the pacifier 44 (cf. FIG. 8), the loop 4 reaches its maximum length and thus the pacifier strap 1 its shortest extension between the crest 47 of the loop 4 and the end of the pacifier strap 1 on the side of the pacifier 44. By the pacifier strap 1 shortened in this way, the pacifier 44 is, when it is not in use, advantageously held near the fastening clip 46 and does not hang down from the clothes of a child to which the fastening clip 46 is attached, for example corresponding to the total length of the pacifier strap 1.

Figure 9:
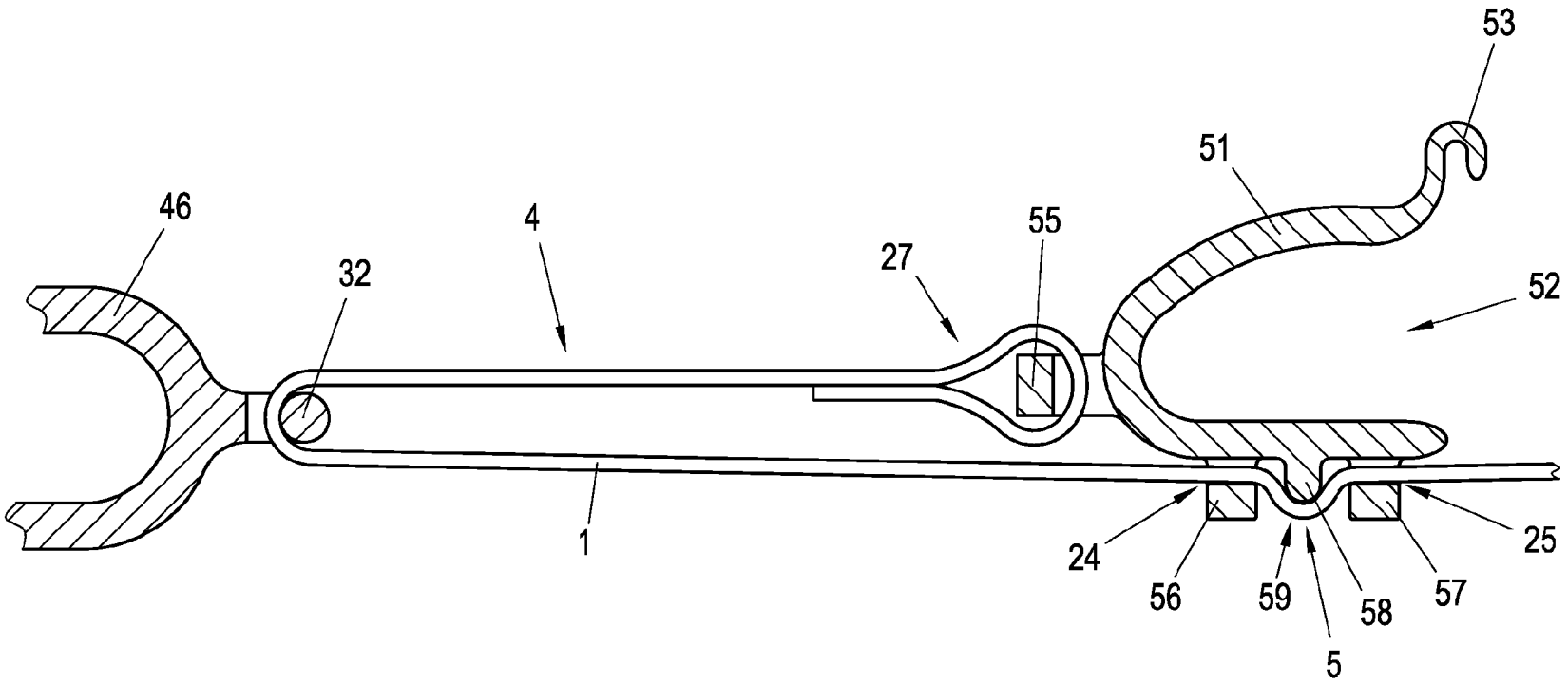
FIG. 9 a sectional view of a pacifier strap with a pacifier and a nipple container including adjustment means.

A slightly modified exemplary embodiment with a container 51 in the type of a pacifier cap is shown in FIG. 9, this container 51 comprising, at a side of an opening 52 for receiving a pacifier nipple opposed to the adjustment means 5, hook-like connection means 53 for engagement with the edge of a pacifier plate 54 (cf. FIG. 8). The pacifier strap 1 is here, too, connected to the container 51 in two sections, i. e. by means of a fastening loop 27 extending through a retainer ring 55 formed at the container 51 and by means of the adjustment means 5 integrally formed at the container 51, and thus forms a loop 4 of variable length. The loop 4 passes through a retainer ring 32 connected to a fixing clamp 46.

The adjustment means 5 comprise an insertion opening 24 and an outlet opening 25 which are formed by two adjacent retainer rings 56, 57. Between the retainer rings 56, 57, a cross strut 58 is arranged which forces the pacifier strap 1 passing through the retainer rings 56, 57 to bend 59, so that a shifting of the pacifier strap 1 through the adjustment means 5 by frictional connection between the pacifier strap 1 and the cross strut 58 is slowed.

Figure 10:
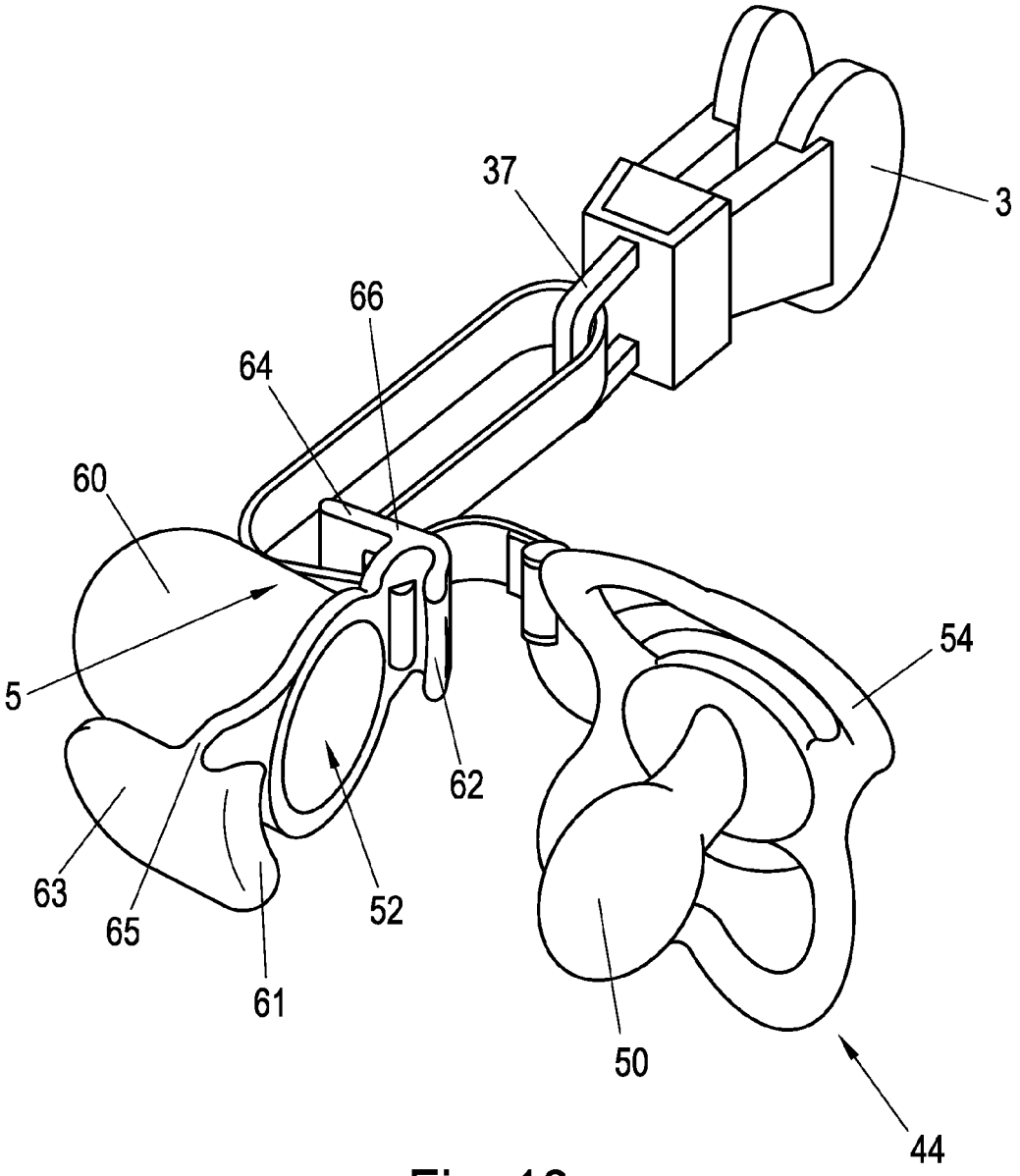
FIG. 10 a pacifier strap with a fastening clip, a pacifier and a pacifier cap with connection means on either side.
Figure 11:
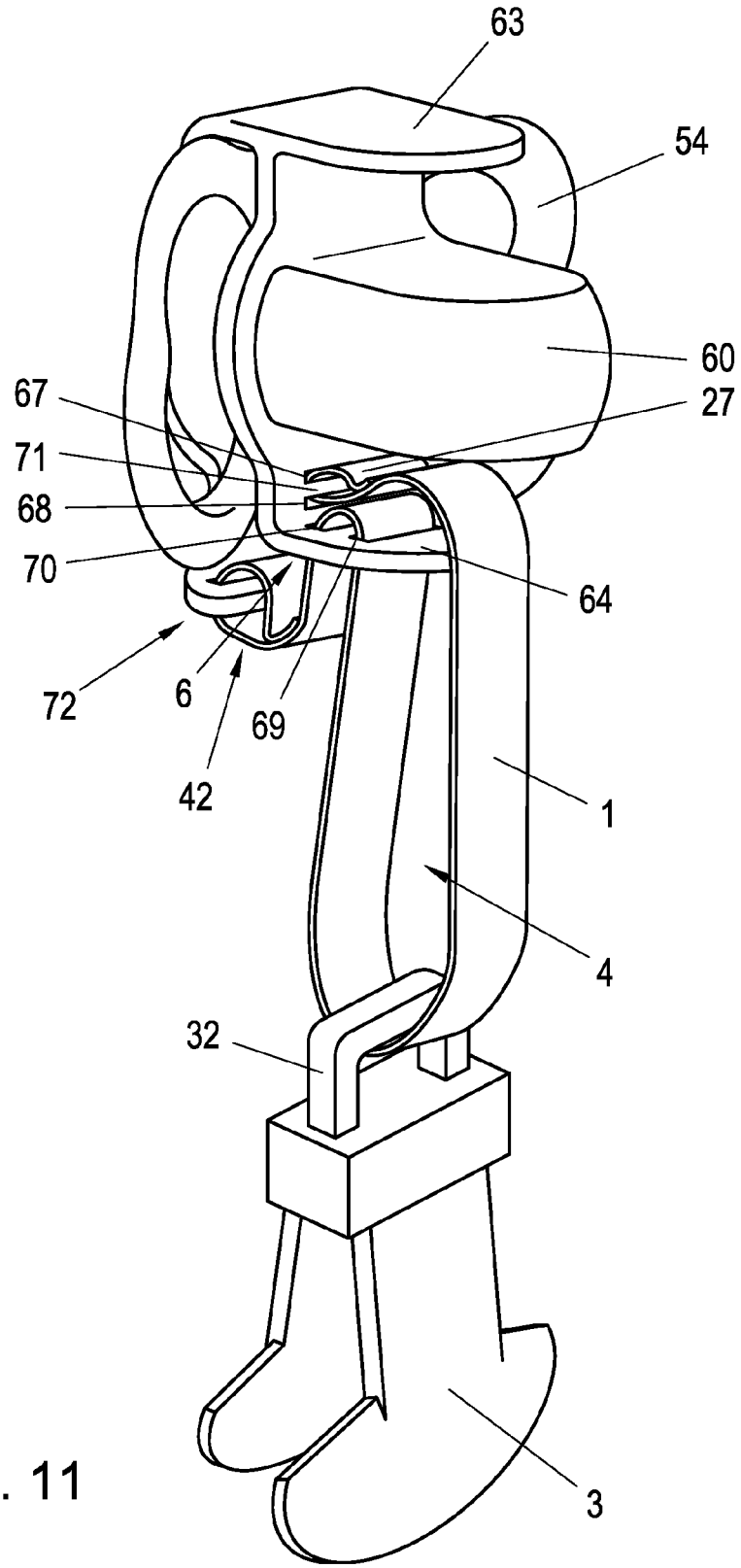
FIG. 11 an arrangement according to FIG. 10, wherein the pacifier cap is arranged in a storage position above the nipple.

A preferred exemplary embodiment is furthermore shown in FIGS. 10 and 11, a container 60 for receiving a pacifier nipple 50 with hook-like connection means 61, 62 arranged at two opposed sides for connection with a pacifier plate 54 being shown here. The two connection means 61, 62 here each have essentially semicircular grip tongues 63, 64 each parallel to a longitudinal axis of the container 60 by which the connection means 61, 62 may be easily released from the pacifier plate 54. In the process, by compressing the two grip tongues 63, 64 towards each other, the connection means 62, 62 are, due to the lever acting via the points of attack 65, 66, lifted to the outside with respect to the opening 52 of the container 60, and a pacifier plate 54 held between the connection means 61, 62 is released.

The adjustment means 5 are, in the example shown in FIGS. 10 and 11, integrated in the grip tongue 64 of connection means 62 by four slot-like openings 67, 68, 69, 70. The first two openings 67, 68 are separated by a web 71 to which a fastening loop 27 of the pacifier strap 1 is connected. The other two openings 69 and 70 correspond to an insertion opening 24 and an outlet opening 25 of a buckle 6, respectively. Thus, the pacifier strap 1 forms an adjustable loop 4 between the buckle 6 and the fastening loop 27 connected to the container 60, in which loop a retainer ring 32 of a fastening clip 3 is arranged. The maximum length of the variable loop 4 is defined by the restriction means 72 connected to the pacifier plate 54, which restriction means cannot be passed through the opening 70 of the buckle 6 corresponding to the outlet opening 25 due to their extension. The connection between the pacifier strap 1 and the restriction means 72 is achieved by a further fastening loop 42.

Figure 12:
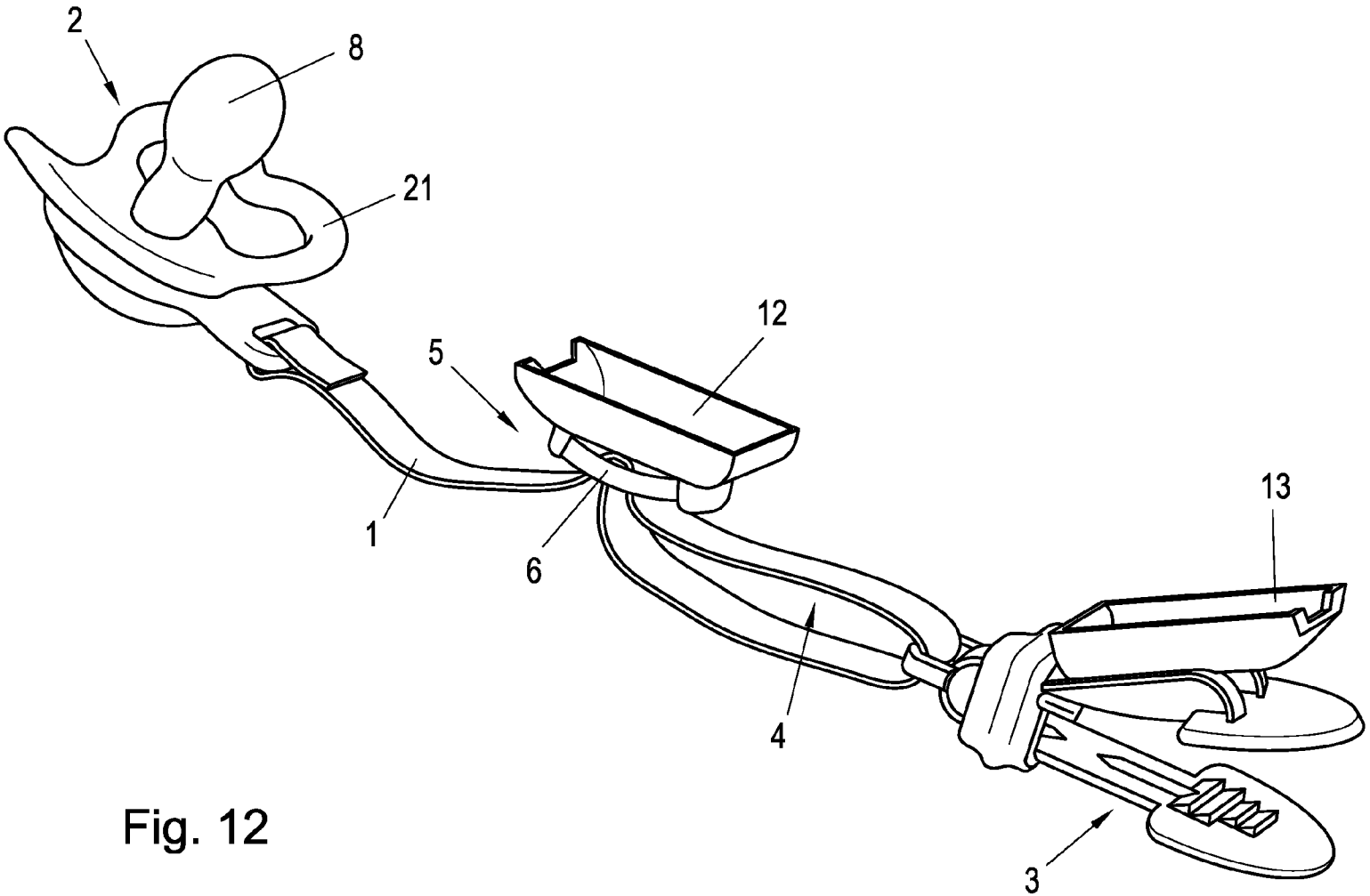
FIG. 12 is a diagrammatic view of an exemplary embodiment with two separable container halves.

In FIG. 12, a further exemplary embodiment is shown, wherein the two container halves 12, 13 are embodied so as to be separable. Here, the container half 12 is preferably firmly connected to the adjustment means 5, and the other container half 13 is preferably firmly connected to the fastening clip 3; the two container halves 12, 13 are here connectable preferably via a snap-in connection (not shown in greater detail). To receive the nipple 8 in the container 7 in a protecting position, the nipple 8 is therefore preferably positioned in the container half 12, and the latter is then snapped onto the container half 13 or the fastening clip 3 while enclosing the nipple 8. Here, a particularly compact embodiment for the accommodation of the nipple 8 or the complete pacifier 2 in the container 7 is achieved.

The invention claimed is:

1. A device for retaining and storing at least a nipple of a pacifier, the device comprising:

a container configured to store at least the nipple of the pacifier;

a pacifier strap configured to connect a fastening clip to the pacifier so as to retain the pacifier, the pacifier strap forming a loop at at least one end;

the fastening clip or the pacifier being held in the loop; and a loop-length adjuster movably connected to the pacifier strap to enable adjustment of a length of the loop between a maximum loop length and a minimum loop length, so as to adjust an effective length of the pacifier strap;

the container being connected to the loop-length adjuster.

2. The device according to claim 1, wherein:

a snap-in connection connects the container to the loop-length adjuster.

3. The device according to claim 1, wherein:

one of the container and the loop-length adjuster comprises a grooved connector structure and another of the container and the loop-length adjuster includes an edge connector structure configured to fit within the grooved connector structure for connecting the container to the loop-length adjuster.

4. The device according to claim 1, wherein:

the loop-length adjuster and the container are integrally formed.

5. The device according to claim 1, wherein:

the container comprises two container halves pivotally connected together.

6. The device according to claim 5, wherein:

one of the container halves is integrally formed with, or firmly connected to, the loop-length adjuster and another of the container halves is integrally formed with, or firmly connected to the fastening clip.

7. The device according to claim 1, wherein:

an invariable length portion of the pacifier strap is connected to the loop-length adjuster; and a variable length portion of the pacifier strap is connected to the loop-length adjuster at the one end of the pacifier strap.

8. The device according to claim 1, wherein:

the loop-length adjuster is a buckle having an insertion opening and an outlet opening; and the pacifier strap passes into and through the insertion opening and passes through and out of the outlet opening of the buckle.

9. The device according to claim 1, wherein:

the pacifier strap comprises a restriction structure configured to define a maximum length of the loop.

10. The device according to claim 8, wherein:

the pacifier strap comprises a restriction structure configured to define a maximum length of the loop; and the restriction structure comprises a stop element protruding from the outlet opening of the loop-length adjuster.

11. The device according to claim 10, wherein:

the stop element comprises a fold of the pacifier strap, the fold being fixed by stitching or a weld.

12. The device according to claim 1, wherein:

the container is guided via the loop-length adjuster at the pacifier strap such that, with the minimum length of the loop, the nipple of the pacifier is guided into the container.

13. The device according to claim 12, wherein:

the container is held in a storage position receiving the nipple by a frictional connection between the loop-length adjuster and the pacifier strap.

14. The device according to claim 1, wherein:

the effective length of the pacifier strap extends between the container and the fastening clip and comprises:

an invariable length portion of the pacifier strap extending from the loop-length adjuster in a first direction toward one of the pacifier and the fastening clip; and a variable length portion of the pacifier strap extending from the loop-length adjuster in a second direction toward another of the pacifier and the fastening clip.

15. The device according to claim 1, wherein:

the container and the loop-length adjuster have respective engaging structures configured to removably connect the container to the loop-length adjuster.

16. The device according to claim 1, wherein:

the container and the loop-length adjuster are permanently connected together.

17. The device according to claim 1 in combination with a pacifier having the nipple the container is configured to store.

* * * * *